US006003457A

United States Patent [19]

Chatelain

[11] Patent Number: 6,003,457

[45] Date of Patent: Dec. 21, 1999

[54] BOAT POWERED BY MEANS OF A KITE VIA A HINGED ARM

[76] Inventor: Pierre Chatelain, Longefonds, 38930-Clelles, France

[21] Appl. No.: 09/067,994

[22] Filed: Apr. 1, 1998

[30] Foreign Application Priority Data

Oct. 26, 1995 [FR] France ..... 95-12622

[51] Int. Cl.[6] ..... B63B 35/00

[52] U.S. Cl. ..... 114/39.11; 114/102.16

[58] Field of Search ..... 114/39.1, 102, 114/103, 102.1, 102.16, 102.29, 39.11, 39.21

[56] References Cited

U.S. PATENT DOCUMENTS 4,934,296 6/1990 Smith et al. ..... 114/39.1

FOREIGN PATENT DOCUMENTS 2624827 6/1989 France ..... 114/39.1

8702480 6/1988 Germany ..... 114/103

232989 10/1986 Japan ..... 114/103

*Primary Examiner*—Jesus D. Sotelo

*Attorney, Agent, or Firm*—Rines & Rines

[57] ABSTRACT

Apparatus for powering a boat by a kite so as to use wind as a prime mover and without generating significant rolling and yawing moments, having, in combination with the boat, an arm hinged at one extremity to the boat with means for controlling the position of the arm in inclination and in orientation, and provided at its free end with means for holding kite connection lines from the boat to the kite, with the free end serving as a kite-pulling traction point; the controlling means enabling the development of a straight traction line for the kite lines to pass close to the center board of the boat as the inclination of the arm is lowered and raised and the orientation in azimuth is varied with respect to the direction of the kite lines.

15 Claims, 6 Drawing Sheets

BOAT POWERED BY MEANS OF A KITE VIA A HINGED ARM

FIELD OF THE INVENTION

The present invention relates to a boat using the pulling power of a kite to move it along.

PRIOR ART

Traditionally, wind-propelled boats use sails, and this in general generates, on the one hand, a rolling moment due jointly to the height of the center of wind thrust and to the direction of this thrust and, on the other hand, a variable yawing moment due to the movement of the center of wind thrust as a function of the trim of the boat.

The boat according to the invention is intended to reduce the rolling and yawing moments by using a kite instead of the sails and by using an articulated arm in place of rigging, by inclining and orientating the articulated arm in such a way as to bring the straight line which geometrically represents the pulling power of the kite close to the center of the centerboard of the boat.

PREFERRED EMBODIMENT OF THE INVENTION

For this, the boat pulled along by a kite comprises an arm which is articulated via a first end to the boat, the point through which the kite strings connecting the kite to the boat pull constituting the second end of the arm, the kite being connected to the boat only by the kite strings. According to one feature of the invention, it comprises a means of controlling the inclination of the arm allowing the latter to be lowered with respect to the direction of the kite strings, and a means of controlling the orientation in terms of azimuth of the arm with respect to the direction of the kite strings, the kite strings all passing through the single pulling point which constitutes the second end of the arm.

According to particular embodiments, the boat may also exhibit other features separately or in combination.

As a preference, the articulation of the arm consists of a rigid intermediate component which has two perpendicular axes of rotation, the first axis, which is vertical, serving as a connection with the boat, the connected end of the arm being attached to the second axis, the arm and the vertical axis of rotation being coplanar. In this case, the means of controlling the arm in terms of inclination advantageously comprises a line of adjustable length connecting a point on the arm to a point on the intermediate component or to a moving point on the boat, or alternatively it comprises a ram connecting a point on the arm to a point on the intermediate component or to a moving point on the boat.

In another embodiment, the means of controlling the arm in terms of orientation comprises two adjustable-length lines, the first line connecting the arm to a point on the boat situated forward of the articulated end of the arm, the second line connecting the arm either to a point on the boat which is aft and left of the articulated end of the arm or to a point which is aft and to the right of the articulated end of the arm.

In yet another embodiment, the means of controlling the orientation in terms of azimuth of the arm is a means which acts directly on the intermediate component to make it turn about its vertical axis.

As a preference, the boat comprises a float situated at the free end of the arm.

Also as a preference, the kite is controlled by its kite strings, of which there are three, the first two strings allowing the kite to be made to turn, and the third string acting on the angle of incidence of the kite.

A pulley is advantageously fixed to the arm, over which pulley there passes a string, of which the two strands, one on either side of the pulley, constitute the first two strings, and a mechanism situated on the arm allowing the length of the third string to be adjusted. In this case, the boat may advantageously comprise a system which has three winders, one for each of the three kite strings, this system being fitted with three functions that can be activated independently of one another, the first function allowing the three strings to be wound up or unwound simultaneously by the same variable length, the second function allowing the first string to be unwound (or wound in) and at the same time the second string to be wound in (or wound out) by the same variable length, the third function allowing the third string to be unwound or wound in by a variable length.

According to one embodiment, the boat comprises a device from which all the kite strings originate and which they all leave in the same direction, it being possible for this device to slide in the corresponding direction, the device being subject to the action of a rope pulling in the opposite direction to the kite strings, this rope being connected to the said arm in such a way that raising the arm leads to pulling on the rope.

According to another embodiment, the boat comprises a device, articulated to the second end of the arm and shaped in such a way as to create an upwards force when this second end of the arm is immersed, when the boat is making way.

The boat may also comprise a ballast which can be either filled with the water surrounding the boat or emptied while the ship is making way.

According to yet another embodiment, the arm is of adjustable length.

BRIEF DESCRIPTION OF THE DRAWINGS

For a better understanding of the present invention, and of other objects, advantages and possibilities thereof, reference will be made to the following description given with no implied limitation and to the appended claims, in combination with the drawings described hereinbelow, in which:

FIGS. 4 to 8 are views upwards in which only the arm and its articulation are depicted; FIGS. 9 and 10 are overall views in which only the part of the kite strings leaving the boat via the articulated arm is depicted;

DETAILED DESCRIPTION OF A PREFERRED EMBODIMENT OF THE INVENTION

Figure 1:
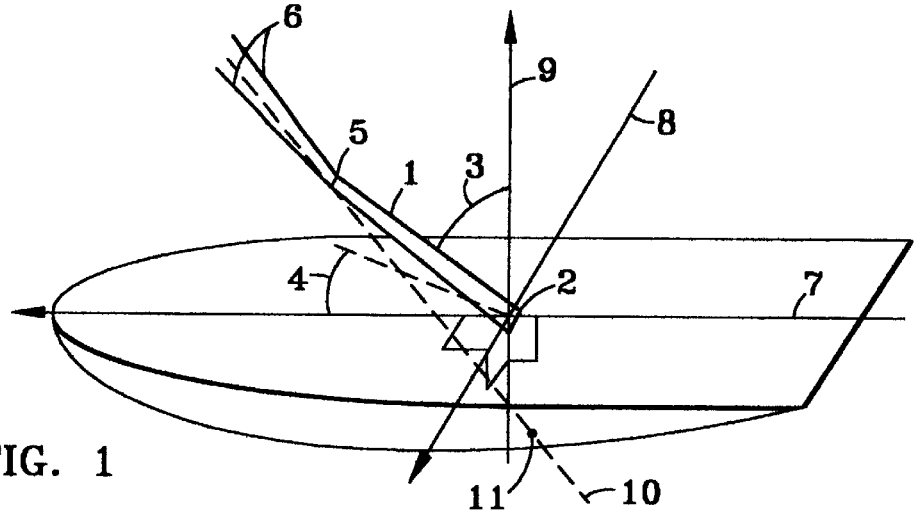
FIG. 1 depicts the boat according to the invention, as an overall view.

Referring now to FIG. 1, the boat pulled along by a kite comprises, according to the present invention, a means of controlling the inclination 3 of the arm 1 allowing it to be lowered with respect to the direction 10 of the kite strings 6, a means of controlling the orientation in terms of azimuth 4 of the arm 1 with respect to the direction 10 of the kite strings 6, the kite strings 6 all passing through the single pulling point which constitutes the second end 5 of the arm 1. Throughout the description the arm 1 can, from the geometric point of view, be likened to the segment formed by its first end 2, known as the connected end, and its second end 5, known as the free end. Thus the free end 5 corresponds to the pulling point. The pulling point 5 may be embodied, for example, by a multiple pulley which is articulated to the arm 1 and over which the kite strings 6 leading to the kite pass. The direction 10 of the kite strings 6 is understood to refer to the mean direction of the kite strings 6, but also to refer to the straight line in the same direction passing through the pulling point 5. In this sense, it can be likened here to the line of pulling action of the kite, and both these two terms are used arbitrarily: this is because, bearing in mind the fact that each of the kite strings 6 exerts on the pulling point 5 a force which, by the physical definition characteristic of a string, is directed along the axis of the string in question and is always a pulling force, on the one hand the straight line of pulling action of the kite, which is the resultant of the elementary forces exerted by each of the kite strings 6, passes through the pulling point 5 and, on the other hand, this same line of pulling action is oriented inside the bundle of kite strings 6 in the direction of the kite, the vertex of which bundle is the pulling point 5. In view of the fact that the vertex angle of this bundle is small, of the order of a few degrees bearing in mind the distance of the kite away, the approximation which consists in likening the line of pulling action of the kite to the direction 10 of the kite strings 6 is therefore justified.

With the boat vertical identified by the axis 9, the inclination 3 of the arm 1 is the angle between this axis 9 and the arm 1. As the longitudinal axis 7 and the transverse axis 8 of the boat are defined and both horizontal, the orientation 4 of the arm 1 is the angle between the projection of the arm 1 on the horizontal plane and the longitudinal axis 7. Note that the three axes 7, 8, 9 are considered as being vectors, and not straight lines in space. The inclination 3 and the orientation 4 of the arm 1 are controlled by any appropriate system, non-limiting examples of which are given below.

Figure 2:
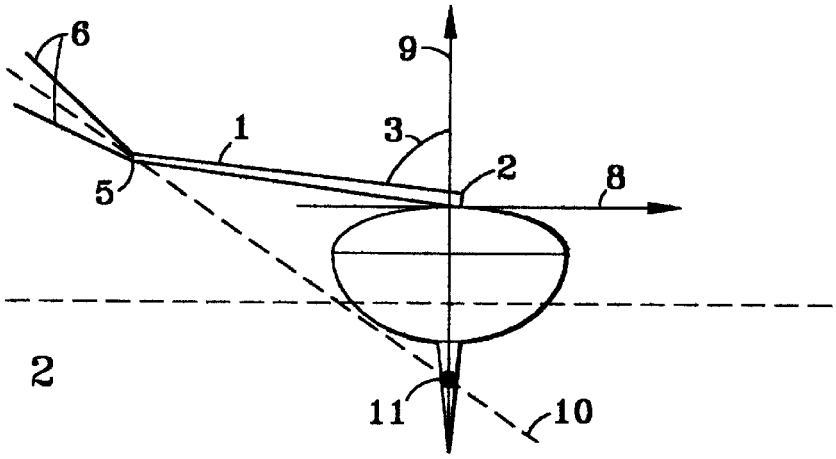
FIG. 2 depicts the boat according to the invention, viewed from the front, as an illustration of how it behaves in terms of roll.

FIG. 2 illustrates the benefit of controlling the inclination 3 of the arm 1; this control makes it possible, by inclining the arm 1, to lower its free end 5 which constitutes the pulling point of the kite, and therefore also the line of pulling action 10 of the kite. If the pulling point 5 is lowered far enough, as in FIG. 2, then the line of pulling action 10 can be made to pass very close to the center of the centerboard 11 of the boat projected onto a vertical plane transversal to the boat, and the rolling moment on the boat can therefore be reduced or even eliminated.

The general benefit of a low rolling moment is that it reduces the requirement for the boat to be stable: with a boat according to the invention, systems of multiple hulls, keels or various ballasts are no longer required necessarily as far as the stability in roll is concerned for sailing close-hauled.

As far as the amount of adjustment in controlling the inclination 3 of the arm 1 is concerned, when the kite is inclined in such a way as to create a horizontal component of pulling on the boat, it needs to be possible for the pulling point 5 to be lowered far enough that, as was seen earlier, the line of pulling action 10 can be made to pass as close as possible to the center of the centerboard 11 in order to create a rolling moment which is only small, or even nil. The required inclination 3 depends on parameters such as the elevation of the kite, the length of the arm 1, the kinematics of the articulation of the arm 1, the relative positions of the articulated end 2 of the arm 1 and of the center of the centerboard 11. Furthermore, it is advisable that it should be possible for the arm 1 to be raised far enough that when the kite is in an almost vertical position, so that the ship is moved along little, the vertical pulling of the kite neither excessively counters the heeling of the boat nor induces excessive stress in the arm 1 and the device controlling its inclination 3.

It should be pointed out that while the device controlling the inclination 3 of the arm 1 has of course to be structurally dimensioned in such a way that it allows the arm 1 to be lowered despite the pulling in the opposite direction exerted by the kite on the free end 5, it is not, however, necessary for the control of the inclination 3 of the arm 1 to be designed also to raise the arm 1. Indeed it has been seen that it was the lowering of the free end 5 of the arm 1 which was the condition for reducing or even cancelling out the rolling moment. This being the case, lines pulling the arm 1 downwards can be used to set a maximum inclination 3, as is achieved in some of the preferred embodiments indicated below. However, a control of the inclination 3 that allows the arm 1 to be raised, such as a ram, may be useful if it is desired for the arm 1 to be used to right the boat, if the latter has capsized, using a float which may be removable or inflatable provided, for example, at the free end 5.

As far as the length of the arm 1 is concerned, it may be recalled, from FIG. 2, that an arm 1 which is shorter, while keeping its free end 5 on the line of pulling action 10 to create the same rolling moment which, in the case of FIG. 2, is practically zero, would have this free end 5 situated further down on this same line 10: a shorter arm 1 has its free end 5 closer to the water. A longer arm experiences higher stresses and has a higher inertia.

Figure 3:
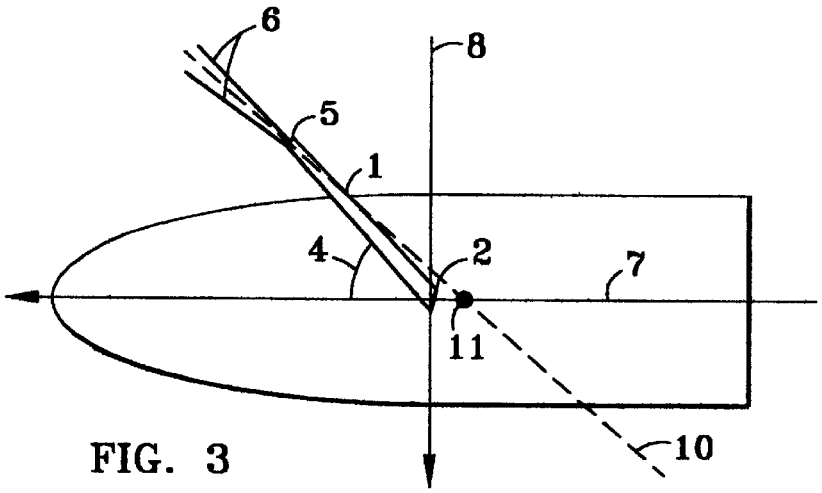
FIG. 3 depicts the boat according to the invention viewed from above as an illustration of how it behaves in terms of yaw.

FIG. 3 illustrates the benefit of controlling the orientation 4 of the arm 1; this control makes it possible to render negligible, or even nil, the yawing moment exerted by the kite on the boat irrespective of the trim of the latter, simply by orientating the arm 1 in such a way that the line 10 lies in the same vertical plane as the center of the centerboard 11, as in FIG. 3. An additional use of controlling the orientation 4 may consist in altering the orientation 4 of the arm 1 from the value which cancels out the yawing moment, so as to create a negative or positive yawing moment capable of turning the boat, and this may, in particular, be beneficial for coming about into the wind. It is advantageous for the center of the centerboard 11 to be positioned as far as possible vertically in line with the point of rotation of the arm in orientation 4; in this case, when the arm 1 is naturally aligned with the direction 10, the boat is neutral in terms of yaw: this makes it possible to reduce the manual exertion or force from an energy source that needs to be exerted for controlling the orientation 4 of the arm 1.

As far as the amount of adjustment of the control of the orientation 4 of the arm 1 is concerned, it is advisable to allow the arm 1 to sweep a field of 160°, at least, distributed symmetrically to the left and to the right of the longitudinal axis 7 of the boat at the front, so that the pulling power of the kite can be used in most trims of boat, from very close-hauled to free-running; having a greater range of orientation 4 of the arm 1, beyond 80° to the left and to the right may, however, make coming about into the wind easier. The fact that in accordance with the invention there is a single pulling point 5 (it being possible in practice for the latter to be achieved by a multiple pulley as has been seen above) is very important, as the example of a kite controlled by its two kite strings illustrates; indeed, for this type of kite, pulling on one or other of the strings allows the kite to be made to turn: these two strings are therefore used to steer the kite. As a boat is constantly subject to oscillations in all directions: pitching, rolling, yawing, if, unlike in the invention, the two strings were to leave from two different points on the boat to lead to the kite (as in document DE-U-87 02480, in which the strings leave from each end of a bar articulated at its middle to the end of a sort of arm) it is obvious that since the overall orientation of the segment consisting of these two points varies with that of the boat, this would be equivalent to pulling on one of the strings and letting go of the other: there would therefore be parasitic control, the effect of which would be greater the longer the segment; it would therefore be necessary continually to perform corrective actions on the control system, for example by constantly altering the orientation of the segment with respect to the boat so that it remains constant in space (and therefore in the opposite direction to the oscillations of the boat) or by winding in/unwinding the two strings. By contrast, when, according to the present invention, the strings all leave the boat via the free end 5 of the arm 1 and close enough together, which in fact corresponds to a segment of almost zero length which can be likened to a single point given the distance that the kite is away, this phenomenon no longer exists: all other things being equal, the control of the kite is far more stable.

As regards the articulated end 2 of the arm 1, the articulation between the latter and the boat may be achieved in various ways: for example, and without implied limitation, it may be flexible using lines or chain links, or alternatively of a mechanical type with definite axes of rotation. The articulation needs to be engineered to withstand the forces resulting from the pulling of the kite on the free end 5 of the arm 1, which forces also depend on the means of controlling the inclination 3 of the arm 1. For simple reasons of symmetry, it is advisable that the articulation of the arm 1 be placed in such a way that the latter can move symmetrically to the left and to the right of the boat. Because the pulling exerted by the kite on the boat has a vertical component, it is recommended that the articulation of the arm 1 be positioned with respect to the center of gravity of the boat in such a way that the action of the kite tends to raise the bow of the boat and not the stern. For stability of the boat under way, it may be beneficial for the center of the centerboard 11 of the boat to be positioned approximately at the same longitudinal point as the articulation of the arm 1.

Figure 4:
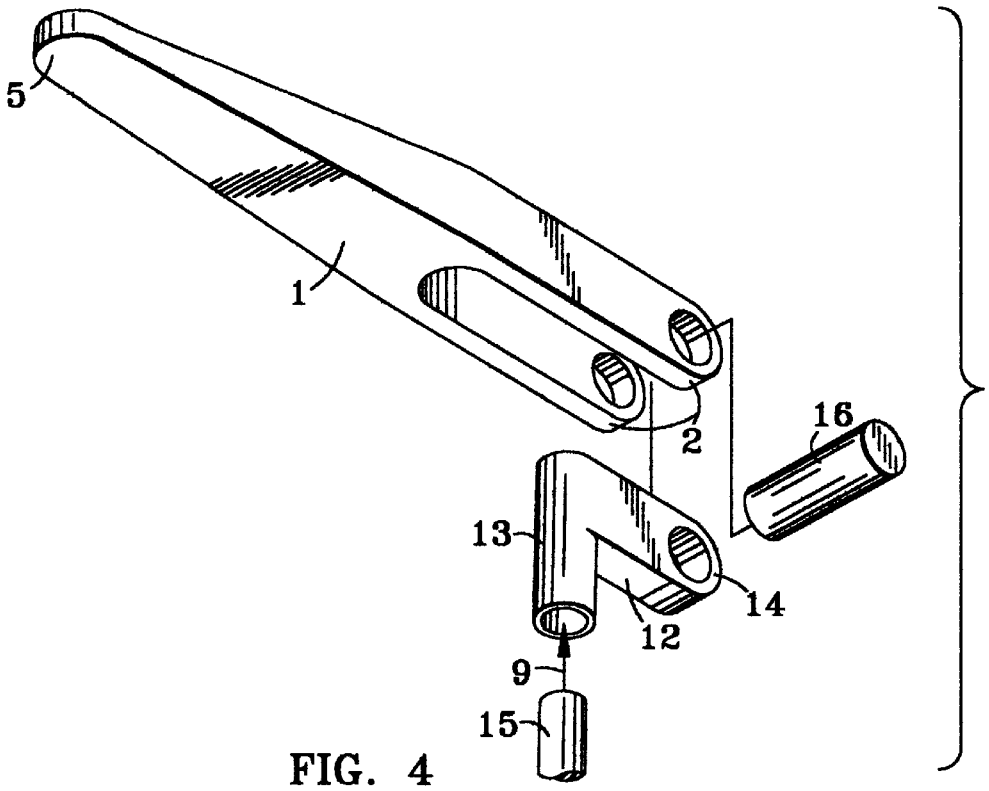
FIGS. 4 to 10 illustrate various features of the boat according to the invention.

Referring now to FIG. 4, the boat according to the present invention comprises, as an articulation for the arm 1, a rigid intermediate component 12 comprising two axes of rotation 13, 14 which are perpendicular, the first axis 13, which is vertical, acting as a connection to the boat, the connected end 2 of the arm 1 attaching to the second axis 14, the arm 1 and the vertical axis of rotation 13 being coplanar. This feature is a non-limiting example of the articulation that there is between the end 2 of the arm 1 and the boat. Although driven by the rotation of the intermediate component 12 about the axis 13, the second axis 14, being perpendicular to the first axis 13 which is vertical, therefore remains horizontal. The additional condition that the vertical axis 13 and the arm 1 be coplanar makes it possible better to balance the forces in the arm 1 and the component 12. FIG. 4 gives a non-limiting embodiment of such an articulation: the connected end 2 of the arm 1 has a forked appearance with two coaxial cylindrical recesses. The axes 13 and 14 are each embodied by a cylindrical recess in the component 12: the first recess, which corresponds to the axis 13, is vertical and takes the vertical cylinder 15 which is fixed to the boat, and this achieves the articulation which allows the orientation 4 of the arm 1 to be varied. The second cylindrical recess is horizontal; it takes the rod 16 after the two cylindrical recesses at the end 2 of the arm 1 have been aligned with its two ends, and this achieves the articulation that allows the inclination 3 of the arm 1 to be varied. It should be noted that as illustrated in FIG. 4, the horizontal axis 14 does not necessarily intersect the vertical axis 13: it may actually be advantageous for the end 2 to be offset for structural reasons or reasons of bulk.

Figure 11:
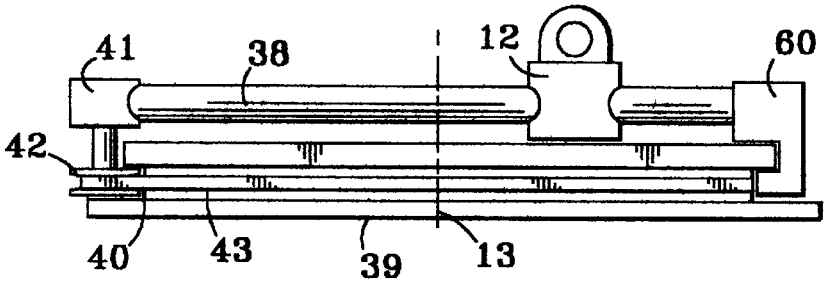
FIG. 11 illustrates another embodiment and depicts an articulation component, in a side view.

There may be other alternative forms. For example, it is possible that the vertical axis 13 may not be embodied by an actual pin, metal or otherwise: the intermediate component 12 may be broadened and on its edges have travellers, of which there are at least three, preferably running on a circular guide (or just a portion of a circle) which is horizontal and fixed to the boat, in the manner of travellers running on a horse; in this case, it is the axis of the circular guide which constitutes the vertical axis 13. FIG. 11 illustrates an embodiment of this type.

Figure 5:
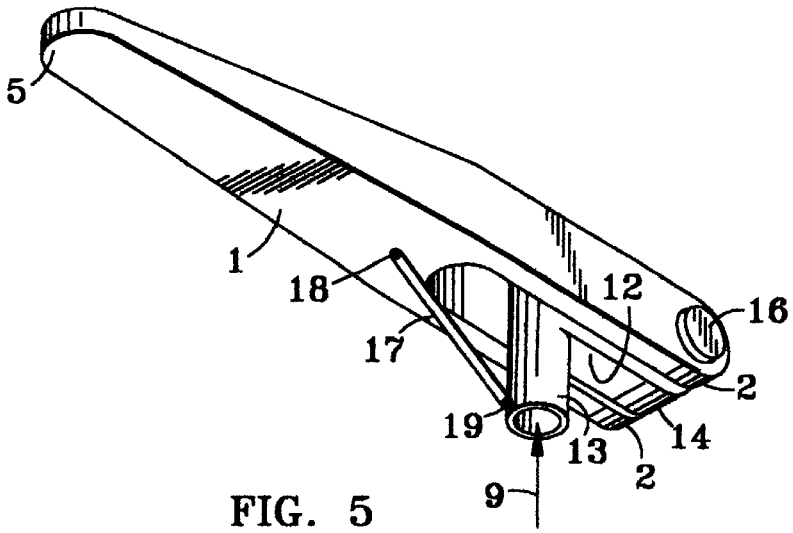

FIG. 5 shows that the boat may, as its means of controlling the arm 1 in terms of inclination 3, have a line 17 of adjustable length connecting a point 18 on the arm 1 to a point 19 on the intermediate component 12. As the point 19 is secured to the intermediate component 12 and not to the actual boat, the pulling on the line 17 which is intended to incline the arm 1 has a neutral effect on its orientation 4. The point 19 has to be situated beneath the arm 1 in order to lower it when the length of the line 17 is reduced, thus fulfilling the role of controlling the inclination 3 of the arm 1. It is advisable that the points 18, 19 be positioned in the plane defined by the arm 1 and the vertical axis of rotation 13, and also in such a way that the line 17 works far enough away from the horizontal axis of rotation 14 that it does not induce excessive stresses in the line 17 and in the component 12 when the kite is pulling. Of course, the line may, in the conventional way, be demultiplied using multiple pulleys.

Figure 6:
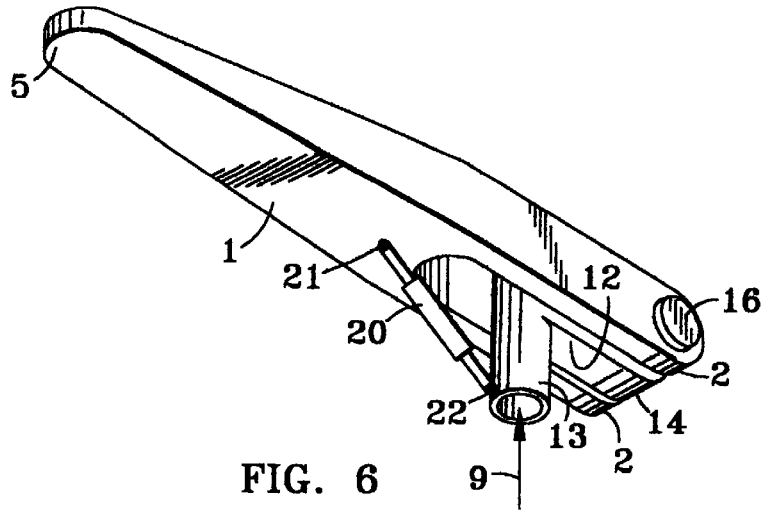

In FIG. 6 the boat has, as a means of controlling the arm 1 in terms of inclination 3, a ram 20 connecting a point 21 on the arm 1 to a point 22 on the intermediate component 12. This means differs from the previous one only in the use of a ram in place of an adjustable-length line, as this also allows the arm 1 to be raised.

Figure 7:
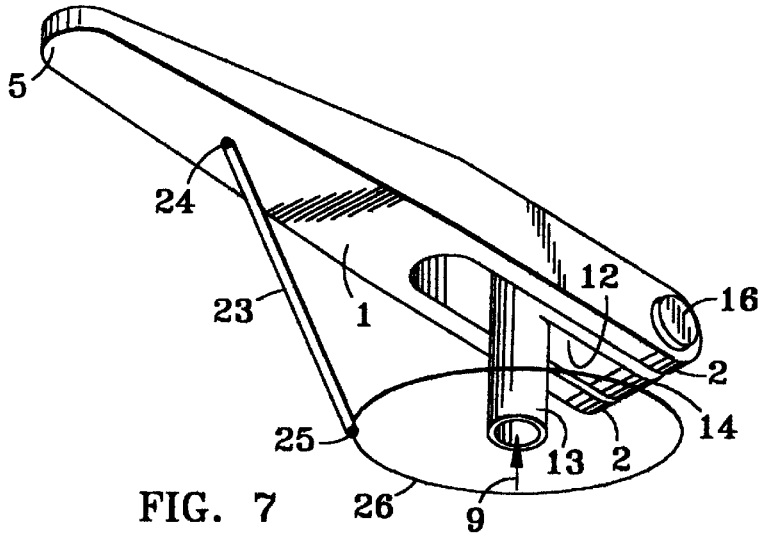

FIG. 7 illustrates another embodiment of the means of controlling the arm. Here, the boat has, as a means of controlling the arm 1 in terms of inclination 3, a line 23 of adjustable length connecting a point 24 on the arm 1 to a moving point 25 on the boat. The difference lies in the fact that the point 25 of attachment of the line 23 is on the boat itself and not on the intermediate component 12. By way of non-limiting example, if, like in FIG. 7, this point 25 is a moving traveller symbolized by a point on a guide 26 of the horse type (symbolized by a line, in FIG. 7) fixed to the boat, in the shape of a circle centered on the vertical axis of rotation 13 of the articulation, then the line 23 does not exert any moment about a vertical axis on the arm 1: pulling the arm 23 with the intention of inclining the arm 1 has, in this case too, a neutral effect on its orientation 4.

Figure 8:
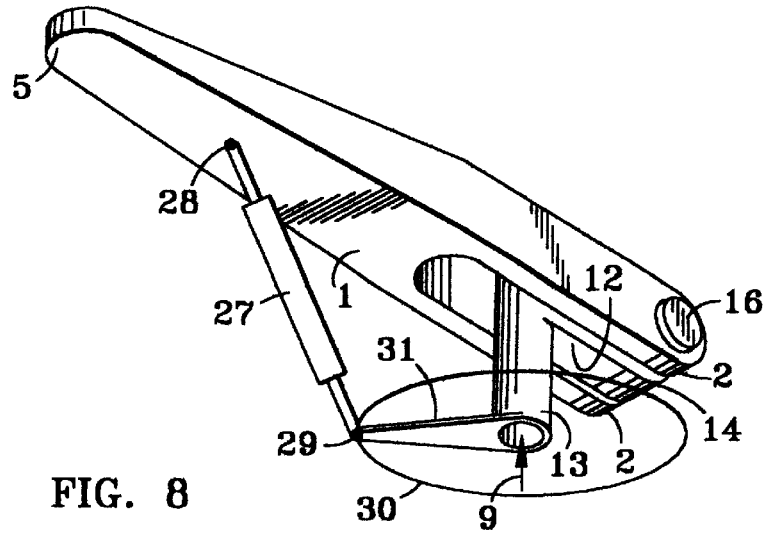

In FIG. 8, the boat according to the invention has, as a means of controlling the arm 1 in terms of inclination 3, a ram 27 connecting a point 28 on the arm 1 to a moving point 29 on the boat. It differs from the previous example only in the use of a ram in place of an adjustable-length line, as this makes it possible also to raise the arm 1. However, it may be necessary to prevent the inadvertent sliding of the moving point 29 under the forces of the ram 27 extending in order to raise the arm 1. As illustrated in FIG. 8 by way of non-limiting example, with the moving point 29 as before being a traveller which can slide on a guide 30 in the shape of a circle centered on the vertical axis of rotation 13 of the articulation, a part 31 of the intermediate component 12 is secured to the traveller (moving point 29): the position of the point 29 on the guide 30 is linked to the orientation 4 of the arm 1 and cannot alter of its own accord when the ram 27 is made to extend.

Figure 9:
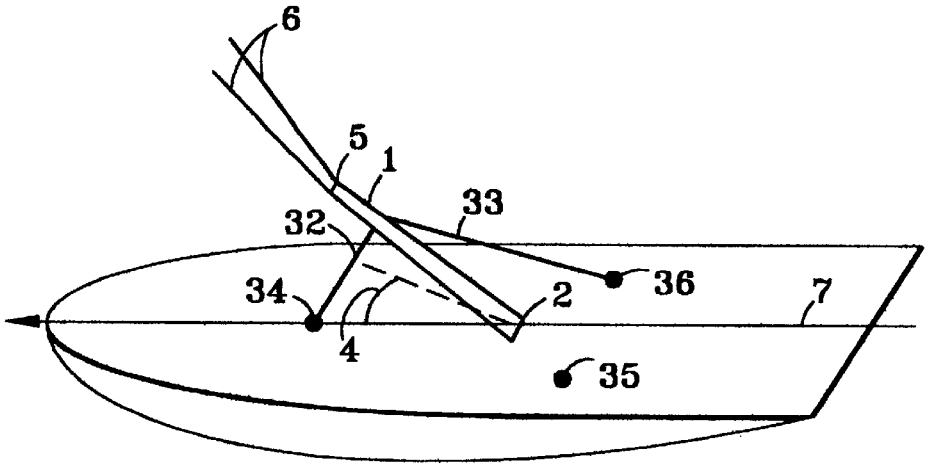

FIG. 9 illustrates a boat according to the invention comprising, as a means of controlling the arm 1 in terms of orientation 4, two lines 32, 33 of adjustable length, the first line 32 connecting the arm 1 to a point 34 on the boat lying forward of the articulated end 2 of the arm 1, the second line 33 connecting the arm 1 either to a point 35 on the boat lying aft and to the left of the articulated end 2 of the arm 1 or to a point 36 situating aft and to the right of the articulated end 2 of the arm 1. Coordinated pulling of both lines 32, 33 on the arm 1 in practically opposite directions has the effect of forcing the arm 1 into a given orientation 4. The use of just the cord 32 allows the orientation 4 of the arm 1 to be limited to a maximum value, with a view to preventing the arm 1 from being dragged backwards if it touches the water while the boat is moving forwards, or the arm 1 to be restrained in order to prevent it from possibly hitting the superstructure of the boat when coming about into the wind, the kite changing from one side of the boat to the other across the stern of the boat, therefore pulling the arm 1 backwards. The point 35, or the point 36, is used to attach the line 33 to the boat, depending on whether the arm 1 is oriented to the left (or to the right) of the boat: the work of the line 33 is thus improved, especially when this line 33 is short.

Figure 10:
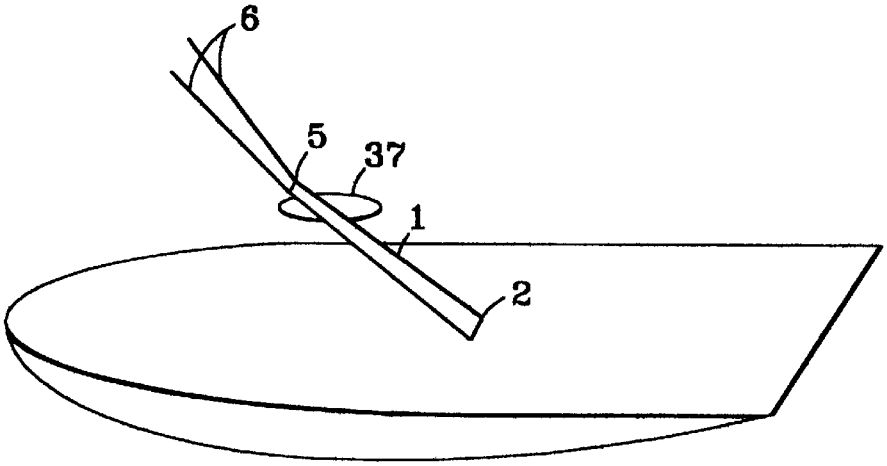

In FIG. 10, the boat has a float 37 situated at the free end 5 of the arm 1. The function of this float 37 is to increase the stability of the boat when it is stationary, the arm 1 being oriented across the boat and its free end 5 lowered to water level. When the boat travels forwards, the float 37 may touch the water at varying angles because the orientation 4 of the arm 1 itself varies: it may be necessary for the connection between the float 37 and the arm 1 to be articulated, especially if the float 37 is profiled. A second function of this float may, if the control of the inclination 3 of the arm 1 allows the arm to be raised, for example if a ram is used, be that of participating in righting the boat if the latter has capsized: if the arm 1 is raised (when the boat is overturned, this in fact consists in lowering the arm 1 into the water), the float 3 will then exert a righting moment on the boat. This float 37 may also be removable or inflatable.

FIG. 11 depicts a boat which, as a means of controlling the orientation in azimuth 4 of the arm 1 comprises a means acting directly on the intermediate component 12 to make it turn about its vertical axis 13; in the embodiment illustrated in FIG. 11, the intermediate component 12 has a part 38 which could be called the orientation lever. A second component, called the orientation guide 39 and secured to the boat, is depicted roughly as a circular component, in fact centered on the vertical axis of rotation 13 of the intermediate component 12, and having a groove 40 on its external part; as the orientation 4 of the arm 1 is changed, the end of the orientation lever 38 follows the orientation guide 39: to guide the rotation of the component 12, three guide travellers, of the same type as the traveller 60 (the only one of the three depicted in FIG. 11), distributed on the orientation guide 39 and secured to the intermediate component 12 may be used. In FIG. 11, an electric motor 41 drives a reel 42 of vertical axis, lying at the end of the orientation lever 38, which on one side reels in and on the other side pays out a belt 43, situated in the groove 40 of the orientation guide 30; this belt 43 may pass around the guide 39 several times to ensure good adherence thereto, or may be toothed. Rotating the reel 42 in one direction or the other thus controls the movement of the orientation lever 38 along the orientation guide 39 and thus ultimately controls the orientation in terms of azimuth 4 of the arm 1. This example is not in any way limiting, especially as regards the control being motorized, as this control may be manual, a cable connected at its middle to the end of the orientation lever 38 replacing the belt 43 and sliding in the groove 40, the control in terms of orientation 4 then consisting in pulling on this cable via its ends or in using some other type of motorized drive, or alternatively in using a geared system such as a pinion meshing directly with the orientation guide.

Figure 12:
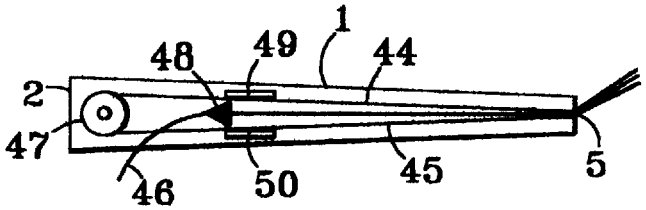
FIG. 12 illustrates another embodiment and depicts an arm, viewed from above.

When the kite used is of the type controlled by kite strings 6, which is a very common case, the control system may be situated on the arm 1 itself, and this simplifies the path of the strings 6 as far as the free end 5 of the arm. Two examples of such a control system are given below for the case where the kite is of the type with three strings, the first two strings 44, 45 making it possible to make the kite turn to the left or to the right, the third string 46 acting on the angle of incidence of the kite and allowing its pulling power to be altered. FIG. 12 thus illustrates a first system for controlling the kite, and FIG. 13 another more sophisticated system.

In FIG. 12, the boat comprises a pulley 47 fixed to the arm 1 and over which there passes a string, of which the two strands, one on either side of the pulley 47, constitute the two steering strings 44, 45 of the kite, and a mechanism 48 (a simple jammer in FIG. 12) situated on the arm 1 and allowing the length of the angle-of-incidence string 46 to be adjusted. This system for controlling the kite is suited to boats of a small size. Two handles 49, 50 may be fixed to the steering strings 44, 45, thus allowing a crew member to control the direction of the kite; it is then advantageous for the pulley 47 to be located far from the pulling point 5 which, for example, consists in a triple pulley articulated to the arm 1 in order to allow these handles 49, 50 the maximum range of movement and, if the kinematics of the arm 1 allow this, it is practical for the crew member concerned for the handles 49, 50 to be in their middle position, close to the axis of the boat. The jammer 48 may be replaced by a winding system.

A safety system, for if the helmsman falls overboard, may be produced, acting automatically, as the helmsman drifts away, on the third string 46; if pulling on the latter reduces the angle of incidence of the kite, the helmsman can be tied to the end of the third string 46 which will be pulled on when the boat moves away from the helmsman who has fallen overboard. If, on the other hand, it is lengthening of the third string 46 which reduces the angle of incidence, then a system may be provided for unjamming or letting go of the third string 46, also controlled by the helmsman drifting away (a rope connecting the latter to the unjamming system, a snap shackle which opens under load, for example).

Figure 13:
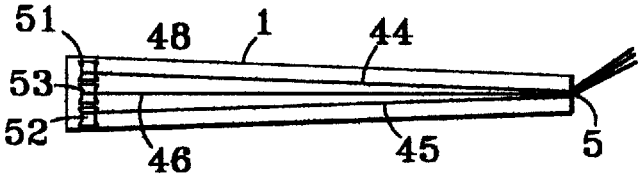
FIG. 13 illustrates another embodiment and depicts an arm fitted with a system for controlling the kite strings, viewed from above.

FIG. 13 illustrates a boat which comprises a system which has three windlasses 51, 52, 53, one for each of the three kite strings 44, 45, 46, this system being fitted with three functions that can be activated independently of one another, the first function allowing the three strings 44, 45, 46 to be wound in or unwound by the same variable length, the second function allowing the first string 44 to be unwound, or wound in, respectively, and at the same time the second string 45 to be wound in or unwound respectively by the same variable length, the third function allowing the third string 46 to be unwound or wound in by a variable length. In FIG. 13, the three windlasses 51, 52, 53 are situated on the arm 1: the windlass 51 controls the first steering string 44, the windlass 52 the second steering string 45, and the windlass 53 the angle-of-incidence string 46. The three functions required may be provided, for example, using three electric motors driving the windlasses 51, 52, 53 (one motor for each windlass). Each motor needs to be slaved to the rate of winding or length of winding of the string that it controls; for this, it is advisable, on the exit of the windlasses 51, 52, 53 for there to be speed or length sensors because, in practice, the same rotation of two windlasses, such as those 51, 52 of the steering strings 44, 45 will not necessarily wind in (unwind) the same length of string, this being as much on account of the variations in what is actually wound on the windlasses, as on account of differences in the tension of the strings, this problem being experienced all the more strongly the longer the lengths of string. Fitted with these sensors, the three motors are synchronized for the first function, so as to provide identical speeds of winding; for the second function the first two motors operate in such a way as to ensure opposite speeds of winding, the third motor being stopped; and for the third function just the third motor is used. A special benefit of motorizing in this way lies in the possibility of quickly winding in all of the kite strings 44, 45, 46 if the wind is taken out of the kite either on account of a navigational error or on account of a sudden and temporary drop in wind: winding in the kite strings 6 quickly makes it possible, just like a kite-flyer running backwards, to recreate relative wind and continue to fly the kite. It is also easy with such a control system to adjust the overall length of the kite strings 44, 45, 46 to suit the sailing conditions: lengthening them in the case of irregular wind in order then to have a margin for shortening them, looking for better conditions at altitude (the wind being better sustained and more uniform higher up).

Figure 14:
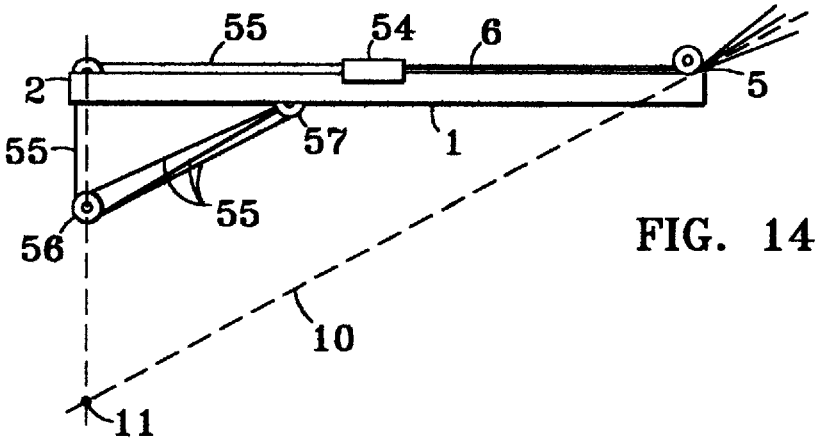
FIG. 14 illustrates another embodiment and depicts the arm fitted with a rope for balancing the pulling power of the kite, in a side view.

In FIG. 14, the boat comprises a device 54 from which all the kite strings 6 originate and all leave in the same direction, it being possible for this device 54 to slide in the corresponding direction and it being subject to the action of a rope 55 pulling in the opposite direction to the kite strings 6, this rope 55 being connected to the arm 1 in such a way that a raising of the arm 1 causes pulling on the rope 55. The benefit of this embodiment is that it provides assistance to the means of controlling the inclination 3 of the arm 1, this assistance being proportional to the pulling power of the kite. Indeed, the more the kite pulls on its kite strings 6, the greater the force to be provided by the means of controlling the inclination 3 in order to lower the arm 1. This pulling force of the kite strings 6 is used to assist in lowering the arm 1. In general, the device 54 comprises, as appropriate, the system for controlling the kite strings 6; for example, in the case illustrated in FIG. 12, this could be a chassis, supporting both the pulley 47 and the jammer 48, sliding along the arm 1. In the case illustrated in FIG. 13, this could be the control system itself sliding along the arm 1. In the example illustrated in FIG. 14, the center of the centerboard 11 lies vertically beneath the connected end 2 of the arm 1, and the kite strings 6 will leave the device 54 in the direction of the free end 5 of the arm 1; the device 54 therefore slides along the arm 1. Via appropriate pulleys, the rope 55 passes over the connected end 2 of the arm 1, runs around the point 56 lying one third of the way along the segment [connected end 2—center of the centerboard 11], and reaches the point 57 located one third of the way along the segment [connected end 2—pulling point 5] having made an outward and return journey between the points 56 and 57: the rope 55 is tripled between the points 56 and 57 by means, for example, of a double pulley at the point 56 and of a becket pulley at the point 57. As the triangle (connected end 2—center of centerboard 11—pulling point 5) and the triangle (connected end 2—point 56—point 57) are similar triangles with a scaling factor of 3, it can be seen that when the arm 1 is inclined in such a way that the line of pulling action 10 passes through the center of the centerboard 11, the moment exerted by the kite strings 6 with respect to the connected end 2 is compensated for by the moment exerted by the rope 55, because the latter via the device 54 receives the same pull of the kite strings 6, and three times the latter between the points 56 and 57. Thus, when the arm is in a position which is theoretically one of equilibrium, the line of pulling action 10 passing through the center of the centerboard 11, the means of controlling the inclination 3 of the arm 1 is completely free of load; this therefore allows small variations in the adjustment of the inclination 3 about this position with a small expenditure of energy. To pretension the rope 55, it is possible to provide a return system, a sandow, for example, pulling the device 54 in the same direction as the kite strings. Furthermore, the amplitude of sliding of the device 54 needs to be provided on the arm 1: in the case of FIG. 14, if the arm 1 is to be able to be inclined between the horizontal and the vertical, this amplitude equates to about 40% of the length of the arm 1 (connected end 2—pulling point 5 segment).

Figure 15:
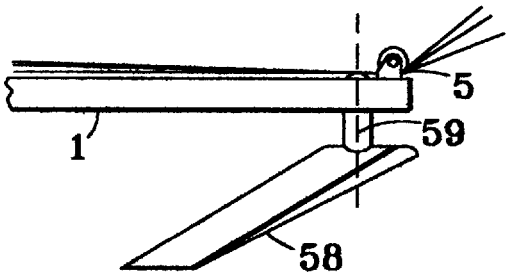
FIG. 15 illustrates another embodiment and depicts the second end of the arm equipped with a profiled device, in a side view.

In FIG. 15, the boat has a device 58 articulated to the second end 5 of the arm 1 and profiled in such a way as to create an upwards force when this second end 5 of the arm 1 is immersed, while the boat is making way. When the boat is making way the arm 1 is generally oriented roughly towards the front of the boat; if for any reason excessive heeling or a higher wave for example, the end 5 of the arm 1 meets the water, it is possible, depending on its shape, that it may tend to want to dig deeper into the water, and this may unbalance the boat. To overcome this, it is possible either for the arm 1 to be profiled differently so as not to create this downwards force, or therefore to attach to its end 5 a profiled device 58, for example such as in FIG. 15, a simple inclined plane which will hydrodynamically create an upwards force if it is immersed. This device 58 needs to be able to orientate itself along the axis of the boat, irrespective of the actual orientation 4 of the arm 1, and so it is articulated. As in FIG. 15, the articulation may be a simple vertical axis 59 for the running inclination 3 of the arm 1—the running inclination 3 is horizontal in FIG. 15, or this may be a ball joint. This device may also be combined with a float 37 as described earlier.

Figure 16:
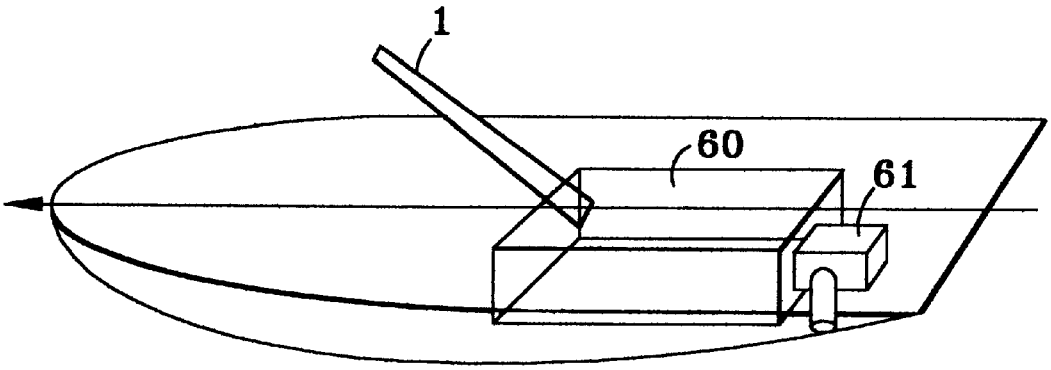
FIG. 16 illustrates another embodiment and depicts the boat equipped with ballast in its hull, this hull being depicted as transparent in order to show the ballast.

FIG. 16 illustrates a boat which has ballast 60 which can either be filled with the water surrounding the boat or emptied while the boat is making way. The benefit in this arises out of the use of a kite for pulling a boat along; the pulling power of the kite on the boat gives rise to an upwards vertical component, representing for example 50% of its value, when the kite is at 30° to the horizon; this vertical component has a positive effect on the boat because it lightens it, thus reducing its apparent weight; however, above a certain wind speed, the apparent weight of the boat may become too low: there is then the risk that the boat will temporarily come out of the water, and this will cancel out the work of its stabilizer planes, to the detriment of the heading of the boat and its overall speed. To overcome this, it is therefore possible to use ballast 60 which is filled with water, for example by means of the reversible pump 61, when the ship gains speed and therefore when the relative wind increases, so as to keep enough apparent weight: the ship can thus go more quickly, because the stabilizer planes will work effectively. Conversely, when the boat loses speed, deliberately or when the actual wind drops down, the ballast 60 is emptied in order to lighten the boat, for example using the reversible pump 61. Unlike ballast in conventional single-hold vessels designed to shift water from one side of the boat to the other, the ballast 60 needs to be well balanced laterally so that it does not create parasitic heeling of the boat, although this does not prevent it from being designed as a number of volumes.

Figure 17:
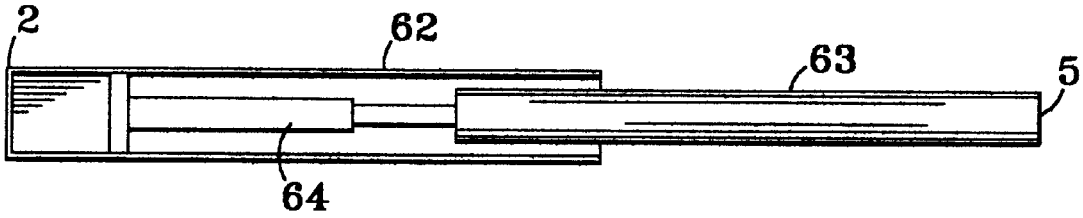
FIG. 17 illustrates another embodiment and depicts, in a side view, a telescopic arm equipped with a ram, the base of the arm being depicted as transparent in the figure in order to show the ram.

In FIG. 17, the arm of the boat is adjustable in terms of length. The influence of the length of the arm 1 was seen earlier in connection with the embodiment depicted in FIG. 2. A longer arm makes it possible to obtain the same position on the line of pulling action 10, and therefore the same equilibrium of the boat in terms of heeling, with a pulling point 5 which is situated higher up, and this is an advantage. Conversely, a shorter arm is certainly stronger. The benefit of being able to adjust the length of the arm 1 is that by lengthening it, it becomes possible to situate the pulling point 5 higher up: this makes it possible, for example, to adapt to heavier seas so as to prevent the arm 1 from touching the water too often. If the length of the arm 1 can be adjusted during sailing, like FIG. 17 illustrates with an arm 1 which is telescopic in two parts 62 and 63 respectively supporting its connected end 2 and its free end 5, a ram 64 situated inside the part 62 making it possible to slide the part 63 with respect to the part 62, it is possible, to a certain extent, depending on the possible range of variation of length of the arm 1, to control the equilibrium in terms of heeling of the arm 1 using this length adjustment, leaving the angle of inclination 3 of the arm 1 fixed: this is because varying the length of the arm 1 alters the position of the pulling point 5, and therefore of the line of pulling action 10, which makes it possible to adapt to different elevations of the kite (that is to say different inclinations of the line of pulling action 10).

The boat according to the invention is therefore particularly intended for rapid travel powered by the wind.

Although what has been depicted and described is what is currently considered to be the preferred embodiments of the present invention, it is obvious that a person skilled in the art can make various changes and modifications thereto without departing from the field of the present invention as defined by the appended claims.

What I claim is:

1. A boat pulled along by a kite comprising an arm which is articulated via a first end to the boat, the point through which the kite strings connecting the kite to the boat pull constituting a second end of the arm, the kite being connected to the boat only by said kite strings, comprising means for controlling the inclination of the arm allowing the latter to be lowered with respect to the direction of said kite strings, and a means for controlling the orientation in terms of azimuth of said arm with respect to the direction of the kite strings, said kite stings all passing through the single pulling point which constitutes the second end of said arm, and where in the articulation of said arm consists of a rigid intermediate component which has two perpendicular axes of rotation, the first axis, which is vertical, serving as a connection with the boat, the connected end of the arm being attached to the second axis, said arm and the vertical axis of rotation being coplanar.

2. The boat according to claim 1, wherein said means for controlling said arm in terms of inclination comprises a line of adjustable length connecting a point on said arm to a point on said intermediate component.

3. The boat according to claim 1, wherein said means for controlling said arm in terms of inclination comprises a ram connecting a point on said arm to a point on said intermediate component.

4. The boat according to claim 1, wherein said means for controlling said arm in terms of inclination comprises an adjustable-length line connecting a point on said arm to a moving point on the boat.

5. The boat according to claim 1, wherein said means for controlling said arm in terms of inclination comprises a ram connecting a point on said arm to a moving point on the boat.

6. The boat according to claim 1, wherein the means for controlling the orientation in terms of azimuth of said arm is a means which acts directly on said intermediate component to make it turn about its vertical axis.

7. A boat pulled along by a kite comprising an arm which is articulated via a first end to the boat, the point through which the kite strings connecting the kite to the boat pull constituting a second end of the arm, the kite being connected to the boat only by said kite strings, comprising means for controlling the inclination of the arm allowing the latter to be lowered with respect to the direction of said kite strings, and a means for controlling the orientation in terms of azimuth of said arm with respect to the direction of the kite strings, said kite stings all passing through the single pulling point which constitutes the second end of said arm, and the boat according to claim 1, wherein said means for controlling said arm in terms of orientation comprises two adjustable-length lines, the first line connecting the arm to a point on the boat situated forward of the articulated end of the arm, the second line connecting the arm either to a point on the boat which is aft and left of the articulated end of the arm or to a point which is aft and to the right of the articulated end of said arm.

8. A boat pulled along by a kite comprising an arm which is articulated via a first end to the boat, the point through which the kite strings connecting the kite to the boat pull constituting a second end of the arm, the kite being connected to the boat only by said kite strings, comprising means for controlling the inclination of the arm allowing the latter to be lowered with respect to the direction of said kite strings, and a means for controlling the orientation in terms of azimuth of said arm with respect to the direction of the kite strings, said kite stings all passing through the single pulling point which constitutes the second end of said arm, and comprising a float situated at the free end of said arm.

9. A boat pulled along by a kite comprising an arm which is articulated via a first end to the boat, the point through which the kite strings connecting the kite to the boat pull constituting a second end of the arm, the kite being connected to the boat only by said kite strings, comprising means for controlling the inclination of the arm allowing the latter to be lowered with respect to the direction of said kite strings, and a means for controlling the orientation in terms of azimuth of said arm with respect to the direction of the kite strings, said kite stings all passing through the single pulling point which constitutes the second end of said arm, and wherein said kite used is controlled by kite stings, of which there are at least three, two first strings allowing said kite to be made to turn, and a third string acting on the angle of incidence of said kite.

10. The boat according to claim 9 further comprising a pulley fixed to said arm and over which there passes a string, of which the two strands, one on either side of the pulley, constitute said two strings, and a mechanism situated on the arm allowing the length of the string to be adjusted.

11. The boat according to claim 9 further comprising a system which has at least three winders, one for each of the strings, this system being fitted with three functions that can be activated independently of one another, the first function allowing said strings to be wound up or unwound simultaneously by the same variable length, the second function allowing the first string to be unwound (or wound in) and at the same time the second string to be wound in (or wound out) by the same variable length, the third function allowing the third string to be unwound or wound in by a variable length.

12. A boat pulled along by a kite comprising an arm which is articulated via a first end to the boat, the point through which the kite strings connecting the kite to the boat pull constituting a second end of the arm, the kite being connected to the boat only by said kite strings, comprising means for controlling the inclination of the arm allowing the latter to be lowered with respect to the direction of said kite strings, and a means for controlling the orientation in terms of azimuth of said arm with respect to the direction of the kite strings, said kite stings all passing through the single pulling point which constitutes the second end of said arm, and further comprising a device from which all the kite strings originate and which they all leave the same direction, it being possible for this device to slide in the corresponding direction, the device being subject to the action of a rope pulling in the opposite direction to the kite strings, this rope being connected to said arm in such a way that raising the arm leads to pulling on the rope.

13. A boat pulled along by a kite comprising an arm which is articulated via a first end to the boat, the point through which the kite strings connecting the kite to the boat pull constituting a second end of the arm, the kite being connected to the boat only by said kite strings, comprising means for controlling the inclination of the arm allowing the latter to be lowered with respect to the direction of said kite strings, and a means for controlling the orientation in terms of azimuth of said arm with respect to the direction of the kite strings, said kite stings all passing through the single pulling point which constitutes the second end of said arm, and further comprising a device articulated to the second end of said arm and shaped in such a way as to create an upwards force when said second end of said arm is immersed, when the boat is making way.

14. A boat pulled along by a kite comprising an arm which is articulated via a first end to the boat, the point through which the kite strings connecting the kite to the boat pull constituting a second end of the arm, the kite being connected to the boat only by said kite strings, comprising means for controlling the inclination of the arm allowing the latter to be lowered with respect to the direction of said kite strings, and a means for controlling the orientation in terms of azimuth of said arm with respect to the direction of the kite strings, said kite stings all passing through the single pulling point which constitutes the second end of said arm, and further comprising a ballast which can be either filled with the water surrounding the boat or emptied while the boat is making way.

15. A boat pulled along by a kite comprising an arm which is articulated via a first end to the boat, the point through which the kite strings connecting the kite to the boat pull constituting a second end of the arm, the kite being connected to the boat only by said kite strings, comprising means for controlling the inclination of the arm allowing the latter to be lowered with respect to the direction of said kite strings, and a means for controlling the orientation in terms of azimuth of said arm with respect to the direction of the kite strings, said kite stings all passing through the single pulling point which constitutes the second end of said arm, and wherein said arm is of adjustable length.

* * * * *